US008534024B2

(12) United States Patent
Messier

(10) Patent No.: US 8,534,024 B2
(45) Date of Patent: Sep. 17, 2013

(54) MODULAR STAGE, KIT FOR SAME AND METHOD OF ASSEMBLING SAME

(76) Inventor: Michel Messier, Rigaud (CA)

( * ) Notice: Subject to any disclaimer, the term of this patent is extended or adjusted under 35 U.S.C. 154(b) by 367 days.

(21) Appl. No.: 12/929,851

(22) Filed: Feb. 22, 2011

(65) Prior Publication Data

US 2011/0203204 A1 Aug. 25, 2011

(30) Foreign Application Priority Data

Feb. 22, 2010 (GB) ..... 1002927.0

(51) Int. Cl.
*E04H 3/22* (2006.01)

(52) U.S. Cl.
USPC ..... 52/637; 52/6; 52/648.1; 52/636; 52/653.1; 52/646; 52/745.19

(58) Field of Classification Search
USPC ..... 52/653.1, 636–639, 644–646, 648.1, 52/650.3, 659, 664, 633, 6, 79.1, 692–693
See application file for complete search history.

(56) References Cited

U.S. PATENT DOCUMENTS 2,715,970 A * 8/1955 Carr ..... 414/233
3,290,837 A * 12/1966 Weston ..... 52/30
3,355,897 A * 12/1967 Mullen, Jr. ..... 405/268
4,365,618 A * 12/1982 Jones ..... 126/576
5,060,426 A * 10/1991 Jantzen ..... 52/86
5,483,780 A * 1/1996 Stumpf ..... 52/650.3
5,829,941 A * 11/1998 Zamorano Morfin ..... 414/261
6,092,347 A * 7/2000 Hou ..... 52/648.1
6,148,568 A * 11/2000 Beasley ..... 52/65
6,742,311 B2 * 6/2004 Fortier ..... 52/185
7,056,221 B2 * 6/2006 Thirkettle et al. ..... 473/168
8,333,046 B2 * 12/2012 Hedegaard et al. ..... 52/645

FOREIGN PATENT DOCUMENTS

CN 201937504 U * 8/2011

* cited by examiner

*Primary Examiner* — Jeanette E. Chapman

(57) ABSTRACT

A stage comprising a support structure, a stage platform supported by the support structure and a fenced enclosure provided above the stage platform. The support structure includes an upstanding central support column; upstanding outer support columns provided around the central support column substantially equidistant from the central support column with adjacent pairs of the support columns all substantially equidistant; main beam members each extending between the central support column and a respective one of the outer support columns; and transversal beam members each extending between a respective pair of adjacent ones of the outer support columns. The main beam members are fixedly anchored to the central and outer support columns and the transversal beam members are coupled to support channels of the outer support columns while remaining slidable relative thereto.

20 Claims, 5 Drawing Sheets

MODULAR STAGE, KIT FOR SAME AND METHOD OF ASSEMBLING SAME

The present application claims priority from UK Request Application Serial Number 1002927.0 filed on Feb. 22, 2010 the contents of which is hereby incorporated by reference in its entirety.

FIELD OF THE INVENTION

The present invention relates generally to portable stages and, more particularly, to a modular portable stage that can be easily assembled and disassembled on site at public events such as, for example, sports events and the likes.

BACKGROUND

Portable stage systems are known in the art and are useful for providing a stage platform that can be transported, assembled and disassembled on location at various indoor and outdoor show venues.

While prior art portable stage systems generally offer a stage platform that can be readily deployed or otherwise assembled and disassembled on site at public events, they also entail one or more of the following disadvantages. First, the manually assembled and disassembled stage platforms generally comprise a relatively high number of structural components and fastening means that are long, complex and exhausting to assemble and disassemble, which can become a costly disadvantage at public events presenting multiple show venues on a same day.

Also, some portable stage systems includes a readily deployable stage platform integrated to a trailer platform pulled by a tractor truck, or the like. However, these stage platforms cannot be entered on location of selected indoor show venues or outdoor parks. Furthermore, additionally to the fact that the trailer portion of the stage generally occupies a good percentage of the sometimes limited space area around the stage platform, some portions of the trailer often further need to be hidden from view for aesthetical reasons during shows.

In addition, both the manually assembled and readily deployable portable stage platforms generally require specially trained assembly personnel and they generally comprise complex components and articulated mechanical assemblies that are relatively expensive to manufacture.

Against this background, there exist a need for a new and improved portable stage. An object of the present invention is to provide such a stage.

SUMMARY OF THE INVENTION

In a broad aspect, the invention provides a stage, the stage comprising a support structure, a stage platform supported by the support structure and a fenced enclosure provided above the stage platform. The support structure includes a substantially upstanding central support column; a plurality of substantially upstanding outer support columns, the outer support columns being provided around the central support column, the outer support columns being substantially equidistant from the central support column and adjacent pairs of the support columns being all substantially equidistant; a plurality of radially extending main beam members each extending between the central support column and a respective one of the outer support columns; and a plurality of circumferentially extending transversal beam members each extending between a respective pair of adjacent ones of the outer support columns. Each of the outer support columns defines a pair of support channels each for receiving a respective end of one of the transversal beam members thereinto. The main beam members are fixedly anchored to the central and outer support columns and the transversal beam members are inserted in the support channels while remaining slidable relative thereto.

For the purpose of this document, the terminology "substantially" refers to dimensions, geometric relationships and orientations that may differ slightly from the word qualified by "substantially", but not to an extent to which the structural integrity of the proposed stage is compromised. Slight variations from precise dimensions, geometric relationships and orientations are caused, among other possibilities by manufacturing tolerances and the inherent adaptability to slight imperfections in the assembly of the proposed design, among other possibilities.

The support structure is load-bearing and typically, a modular stage platform is removably anchored thereto. Also, typically, the fenced enclosure is provided with one or more access doors.

The structural components of the stage made of a suitably rigid material such as, for examples, rust-protected steel, aluminum, Teflon®, poly vinyl chloride (PVC), wood, or the like, or a combination of these.

In addition to the central support column and outer support columns, the stage includes typically a plurality of intermediate and outer support posts, for supporting respectively a plurality of intermediate and peripheral underside portions of the stage platform. The central and the outer support columns are characterized in that their upper ends are provided with suitably configured hub connectors adapted to support underside portions of the stage platform, as well as anchoring brackets for adjustably anchoring a lower portion of a plurality of fence panels that composes the fenced enclosure.

In some embodiments, the support structure further comprises a plurality of horizontal and angled reinforcement brace members for reinforcing the structural integrity between the plurality of support columns and posts, as well as between the latters and underside portions of the stage platform.

The stage platform is substantially planar and horizontally disposed, and has typically an equilateral polygon shape such as, for example, an equilateral octagon shape, as will be exemplified in the accompanying drawings, or any other suitable equilateral polygon shape. The stage platform generally comprises a central portion and an outer peripheral portion. The central portion is generally represented by a spider web-like structure supporting a multilayer covering, while the outer peripheral portion is generally represented by a relatively narrow catwalk circumscribing the central portion. The fenced enclosure is anchored in hub connectors of the outer support columns such that it substantially delineates the junction between the central and peripheral portions.

The spider web-like structure generally comprises a plurality of elongated main beam members disposed in a substantially horizontal and radially outwardly extending configuration, or wagon-wheel configuration, about a central hub connector provided at the top end of the central support column. The spider web-like structure further comprises a plurality of transversal beam members, with each beam members having a suitable length for being disposed in a substantially equidistant parallel fashion transversally between two adjacent main beam members. The spider web-like structure further comprises a plurality of relatively smaller and radially oriented intermediate beam members disposed perpendicularly between selected parallel transversal beam members.

An important aspect of the modular portable stage system of the present invention is characterized in that the equilateral polygon configuration of the stage platform, in cooperative relation with the suitably configured hub connectors of the central support columns and radially distributed outer support columns of the structure supporting the stage platform, allows to use only a limited amount of fastening means, such as conventional nut and screw combinations, or the like, to maintain the structural integrity of the assembly. Namely, only the radially extending main beam members between the central support column and the outer support columns need to be fixedly anchored therebetween. The transversal and intermediate beam members only need to be slidably engaged in suitably configured U-shaped support channels and brackets provided in hub connector of the outer support columns, as well as along the longitudinal sidewall portions of the main beam members and selected transversal beam members, thus resulting in a substantial economy of time required to assemble and disassemble the stage system.

Some advantages of the present invention are that the invention results in a strong and stable modular portable stage system, whose individual components are easily transported, assembled and disassembled, which doesn't require highly specialized assembly personnel, and which is also relatively simple and economical to produce.

In another broad aspect, the invention provides a kit for assembling a stage, the kit comprising a support structure, a modular stage platform supportable by the support structure and a fenced enclosure positionable above the stage platform. The support structure includes a central support column; a plurality of outer support columns, the outer support columns being positionable around the central support column, each of the outer support columns defining a pair of support channels; a plurality of main beam members each fixedly attachable between the central support column and a respective one of the outer support columns; and a plurality of transversal beam members each positionable between a respective pair of adjacent ones of the outer support columns and coupled thereto in a manner allowing slidable movements of the transversal beam members with respect to the support channels.

In yet another broad aspect, the invention provides a method of assembling a stage using the above-described kit, the method comprising assembling the support structure, assembling the support structure including positioning in an upright position the central support columns; positioning in an upright position the outer support columns at a distance from the central support column that is substantially equal to a length of the main beam member, the outer support columns being positioned circumferentially equidistantly from each other; fixedly anchoring each of the main beam members to the central support column and to a respective one of the outer support columns; coupling each of the transversal beam members to a respective pair of adjacent ones of the outer support columns such that the transversal beam members are supported by the outer support columns while remaining slidably movable with relative thereto. The method further comprises assembling the stage platform on the support structure such that the stage platform is supported by the support structure and assembling the fenced enclosure above the stage platform.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
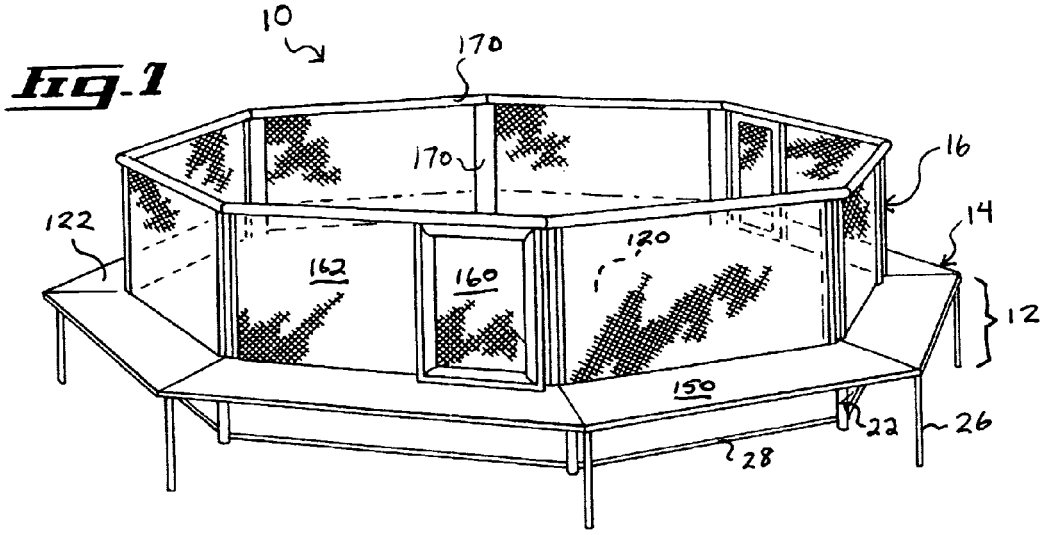
FIG. 1 is a perspective view of a stage according to an embodiment of the present invention.

FIGS. 1 to 8 show various aspects of an embodiment of a stage 10 according to the present invention. As illustrated in FIG. 1, the stage 10 generally comprises a load-bearing support structure 12 on top of which are removably anchored a stage platform 14 supported by the support structure 12 and a fenced enclosure 16 provided above the stage platform 14. The structural components of the stage 10 that will be described hereinafter, are preferably made of a suitably rigid material such as, for examples, rust-protected steel, aluminum, Teflon®, poly vinyl chloride (PVC), wood, or the like, or a combination of these.

FIGS. 1 to 4 inclusively show various aspects of the support structure 12 that generally comprises a substantially upstanding central support column 20, a plurality of substantially upstanding outer support columns 22, and a plurality of intermediate and outer support posts 24 and 26 respectively, for supporting underside portions of the stage platform 14.

The support structure 12 further comprises a plurality of horizontal and angled reinforcement brace members 28 and 30 respectively, for reinforcing the structural integrity between the plurality of support columns and posts, as well as between the latters and underside portions of the stage platform 14.

It is to be noted that, although the general outer peripheral shape of the stage platform 14 and correspondingly configured support structure 12 and fenced enclosure 16 have a substantially equilateral octagon shape, it is to be understood that the stage 10 of the present invention may have any other similar equilateral polygon shape such as, for examples, a pentagon, a hexagon, a heptagon, a enneagon or a decagon shape. Typically, the number of sides of the stage platform 14 is equal to the number of the outer support columns 22.

Figure 3:
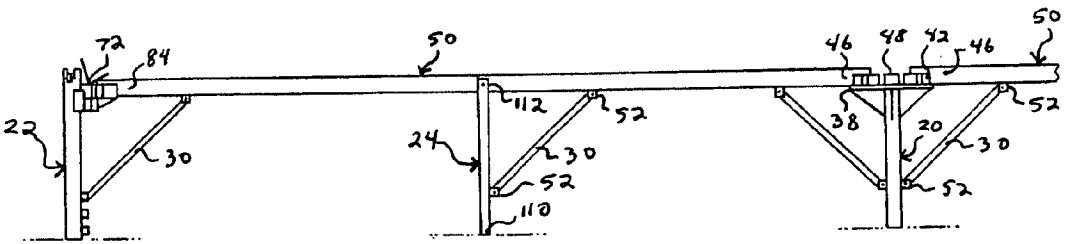
FIG. 3 is a fragmented side plan view of an assembly representing a central support column, an intermediate support post, and an outer support column, all part of the stage shown in FIGS. 1 and 2 and linked through their upper end with an horizontal main support member.
Figure 4:
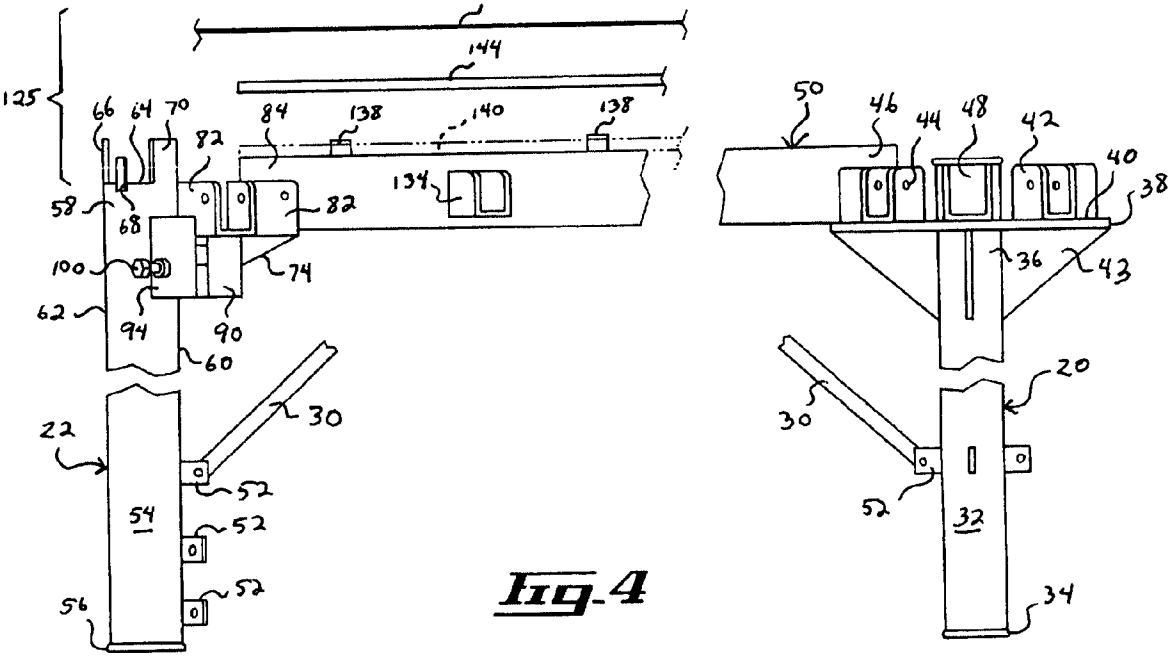
FIG. 4 is an enlarged fragmented view of the assembly shown in FIG. 3.
Figure 5:
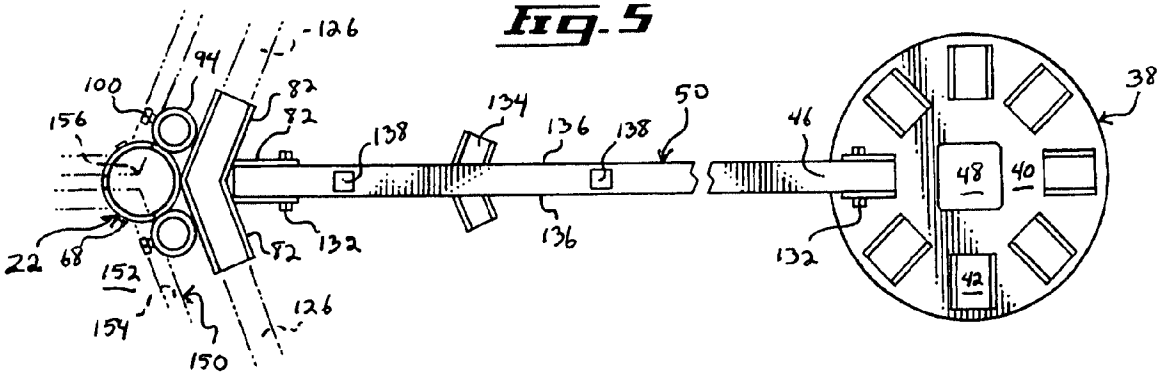
FIG. 5 is a top plan view of the assembly shown in FIG. 4.
Figure 7:
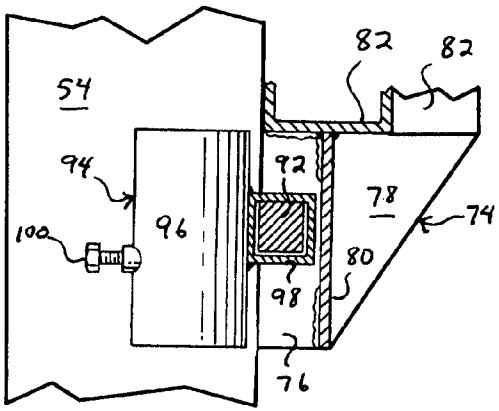
FIG. 7 is an enlarged fragmented, cross-sectional side view of an outer hub connector of the outer support column shown in FIG. 6, taken along section line VII-VII of FIG. 5.

Now referring more particularly to FIGS. 3, 4 and 5, the central support column 20 is typically represented by an upright, main tubular member 32 having a substantially planar base end 34 and an upper end 36 crowned with a central hub connector 38, for supporting a central portion of the stage platform 14.

The central hub connector 38 is generally represented by a preferably substantially round-shaped plate member 40 that is welded or otherwise fixedly attached perpendicularly centrally on top of the upper distal end of the main tubular member 32. Typically, the plate member 40 is structurally reinforced through equidistantly radially disposed triangular plate members 43 that are fixedly attached between underside surface portions of the plate member 40 and an upper end portion of the main tubular member 32.

The central hub connector 38 defines a plurality of main beam attachments fixedly attaching a respective one of the main beam members 50 to the central hub connector. Typically, the top surface of the round plate member 40 is provided with a plurality of substantially upwardly opening U-shaped brackets 42 that are equidistantly radially distributed proximal the outer circumferential edge of the plate member 40, thus forming open vertical slots oriented substantially radially outwardly thereof and defining the main beam attachments. Each U-shaped brackets 42 are provided with transversally corresponding through holes 44.

The U-shaped brackets 42 of the central hub connector 38 are adapted for fixedly engaging the proximal ends 46 of horizontally and radially disposed main beam members 50 of the stage platform 14, which each extend between the central support column 20 and a respective one of the outer support columns 22 and which will be described in details more below.

The top surface of the round plate member 40 is further provided with an upwardly extending, central support bracket 48, which is suitably sized and shaped for supporting a central portion of the stage platform 14.

The central support column 20 is further provided with a plurality, typically four, attachment ears 52 that are equidistantly radially extending outwardly about an outer surface portion of the main tubular member 32, at a suitable position between the base end 34 and the central hub connector 38. The attachment ears 52 are adapted to be attached to one end of a corresponding number of angled reinforcement brace members 30.

The outer support columns 22 are each preferably represented by an upright and hollow main member 54, typically generally cylindrical, having a substantially planar main member base 56, and a longitudinally opposed main member upper end 58, an inner longitudinal side surface 60, which is designed to be oriented inwardly toward the center of the stage platform 14, and an outer longitudinal side surface 62 facing oppositely thereto.

Figure 8:
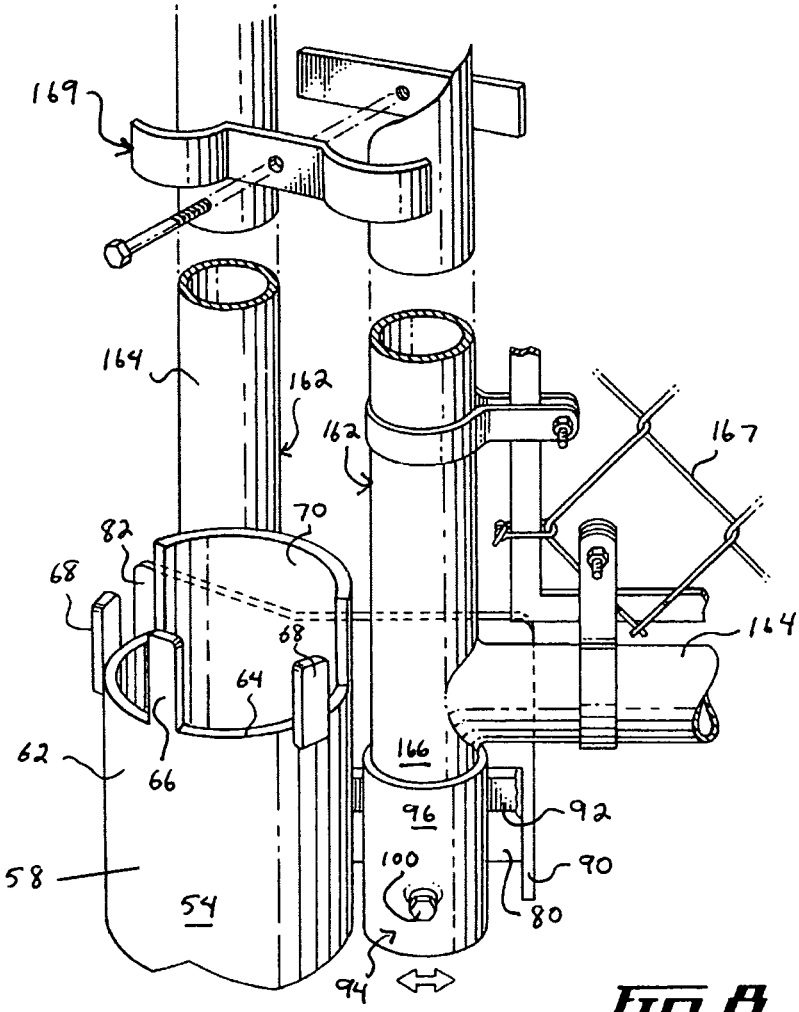
FIG. 8 is a fragmented, perspective exploded view of an assembly representing the junction between the outer hub connector of the outer support column shown in FIGS. 6 and 7, with a lower end corner of two mesh fencing panels.

As best illustrated in FIG. 8, the main member upper end 58 may be left open, with its upper tubular edge being provided with four downwardly extending open slots 64 that are defined by preferably three upwardly extending and relatively narrow prongs 66 and 68, and one relatively wider prong 70.

The narrow prongs 66 and 68 are substantially equidistantly distributed along a half circular portion of the main member upper end 58 that is roughly corresponding to the outer longitudinal side surface 62 of the hollow main member 54, with the relatively wider prong 70 substantially occupying the opposite half circular portion thereof.

It is to be noted that the two narrow prongs 68 disposed adjacently to the wider prong 70 are preferably represented by vertically oriented prong members having a lower end welded or otherwise fixedly fastened to an outer side surface portion of the main member upper end 58. It is further to be noted that, as best observed in FIGS. 4 and 6, the oppositely disposed central narrow prong 66 and wider prong 70 are of a substantially same height, while the two distanced narrow prongs 68 are relatively smaller. The narrow and wide prongs 66, 68 and 70 are suitably sized and shaped for slidably engaging corner portions of peripheral catwalk panels associated with the stage platform 14, which will be described more below.

As best illustrated in FIGS. 3 to 9 inclusively, an upper end portion along the inner longitudinal side surface 60 of the hollow main member 54 is provided with an outer hub connector 72. The outer hub connector 72 generally comprises a vertically disposed central plate member 74 perpendicularly extending from the inner longitudinal side surface 60 of the hollow main member 54, and is adapted to be oriented toward the center of the stage platform 14. The central plate member 74 has a proximal upright rectangular portion 76 and a distal right-triangular portion 78, with the right-angular corner disposed at an upper junction thereof. At the vertical junction between the rectangular and triangular portions 76 and 78 of the central plate member 74, there is a pair of vertically disposed, rectangular plate members 80 that are oppositely laterally extending therefrom at an inner angle relative to one another that is substantially corresponding to a typical inner angle value between two adjacent segments of the equilateral polygon.

The outer support columns 22 each include three upwardly opening U-shaped members 82 defining a pair of support channels oriented for receiving a respective one of the outer transversal beam members 126 coupled to the outer support column. The outer transversal beam members 126 are thus circumferentially extending between a respective pair of adjacent ones of the outer support columns 22. The upwardly opening U-shaped members 82 are centrally longitudinally attached to the upper horizontal edges portions of the distal right-triangular portion 78 and laterally extending rectangular plate members 80. The upwardly opening U-shaped members 82 are each slidably receiving and supporting therein a corresponding distal end of one of the main and outer transversal beam members 50 and 126 associated with the stage platform 14.

Furthermore, the upwardly extending sidewall portions of the upwardly opening U-shaped members 82 have their distal ends provided with a pair of corresponding transversal through holes 86 for fixedly anchoring some or all of the distal ends of the beam members mentioned above. Typically, a conventional nut and screw combination extends through both the upwardly opening U-shaped members 82 to which one of the main beam members 50 is attached and the main beam member 50. However, any other suitable fastener, such as a pin and a bolt, among other possibilities are usable instead of the conventional nut and screw combination.

Figure 6:
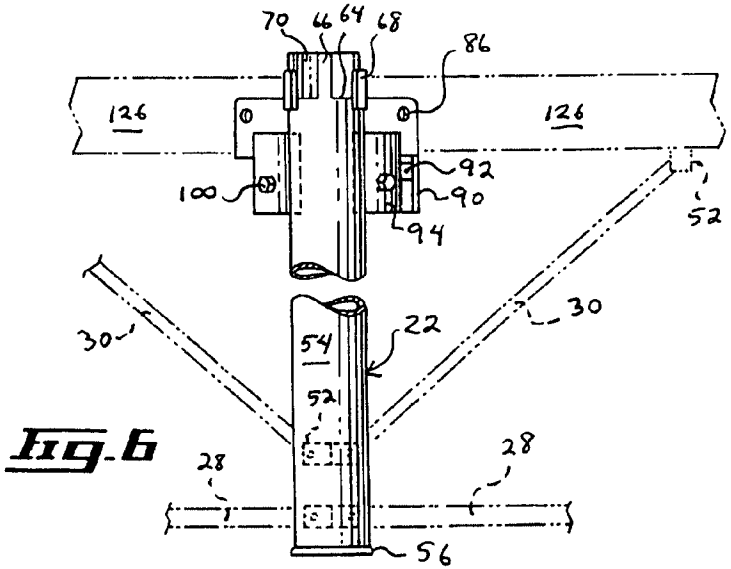
FIG. 6 is a fragmented, exterior side plan view of an outer support column part of the stage shown in FIGS. 1 and 2.
Figure 9:
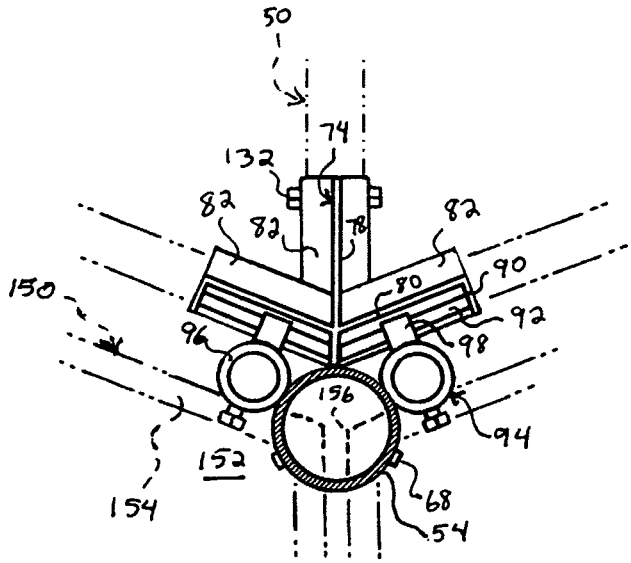
FIG. 9 is a cross-sectional, bottom plan view of the outer support column shown in FIGS. 5 to 8 taken along section line IX-IX of FIG. 6.

Now referring more particularly to FIGS. 6, 8 and 9, each of the distal vertical side edges of the laterally extending rectangular plate members 80 of the outer hub connector 72 is provided with a vertical end plate member 90 that is perpendicularly extending therefrom substantially toward the hollow main member 54.

A horizontally disposed guiding member 92, having preferably a square or rectangular cross-section, is rigidly attached between each of the oppositely disposed side surfaces of the central plate member 74 and the inner side surfaces of the oppositely corresponding end plate members 90. As can be observed in FIG. 7, the guiding members 92 are suitably distanced from, and disposed in a substantially parallel fashion relative to the adjacent rectangular plate members 80. Each guiding members 92 are for guiding the freely slidable lateral movement of an adjustable fence panel anchoring bracket 94, which will be described hereinafter.

The adjustable fence panel anchoring bracket 94 generally comprises an upright and hollow cylindrical member 96 and a relatively short guide channel 98 tangentially welded at roughly a mid longitudinal position along the outer surface of the hollow cylindrical member 96.

The hollow cylindrical member 96 is suitably sized and shaped for freely slidably receiving therein a downwardly extending anchoring member of a fence panel associated with the fenced enclosure 16. The hollow cylindrical member 96 is further provided with a locking screw and threaded hole combination 100 preferably positioned diametrically opposite the guide channel 98. The locking screw and threaded hole combination 100 is for adjustably locking the vertical position of the anchoring member of a fence panel mentioned above.

The guide channel 98 has a suitably sized and shaped cross-section such that it can be freely slidably engageable coaxially about the guiding member 92. Understandably, at least the guide channel 98 of the fence panel anchoring bracket 94 is preferably coaxially engaged along the guiding member 92 prior to welding the latter to the other structural members of the outer hub connector 72.

Therefore, the fence panel anchoring brackets 94 anchor the fence panels 162 to the outer support columns 22 and the anchoring brackets 94 are slidably movable with respect to the remainder of the outer support columns 22 for adjusting their position relative to the outer support columns 22.

The outer support column 22 is further provided with a plurality of attachment ears 52 that are laterally extending outwardly from an outer surface portion of the hollow main member 54, at a suitable position substantially proximal the main member base 56, preferably along the inner side surface 60 thereof. The attachment ears 52 are adapted to be attached to one distal end of a corresponding number of reinforcement brace members 28 and 30, which are having their opposite ends horizontally connected to adjacent outer support columns 22, as well as angularly connected to underside portions of the stage platform 14.

Now referring more particularly to FIG. 3, the support structure 12 further includes a plurality of intermediate support posts 24 for supporting an intermediate underside portion of the main beam member 50, between the central support column 20 and the outer support columns 22.

An intermediate support post 24 may be generally represented by an elongated tubular member having a base end 110 and an upper end 112. The upper end 112 may be provided with, for example, a pair of upwardly extending parallel prongs having a pair of corresponding transversal holes provided there through, and adapted to be removably connected to an underside portion of the stage platform 14 using a nut and screw combination or the like. Typically, at least one attachment ear 52 is perpendicularly laterally extending from a side portion of the intermediate support post 24, preferably proximal the base end 110 thereof, for attaching one end of a reinforcement brace members 30.

As illustrated in FIG. 1, the support structure 12 also further includes a plurality of upright outer support posts 26 for supporting a peripheral underside portion of the stage platform 14, that is a portion of the stage platform 14 that protrudes radially outwardly from the outer support columns 22. An outer support post 26 may be generally represented by a support post that is substantially similar to an intermediate support post 24 described above, e.g., with an upper end that is suitably adapted to be removably connected to an underside portion of the stage platform 14.

The stage 10 includes a substantially planar and horizontally disposed stage platform 14 having an equilateral polygon shape such as, for example, an equilateral octagon shape, as exemplified in the drawings, or any other suitable equilateral polygon shape. The stage platform 14 is supported by a plurality of substantially upright central and outer support columns 20, 22 and intermediate and outer support posts 24, 26, as described above, and which, in turn, may be preferably structurally reinforced between themselves as well as with an underside portions of the stage platform 14 through a plurality of horizontal and angled elongated reinforcement brace members 28 and 30 respectively (as best illustrated in FIGS. 1, 3 and 6).

Figure 2:
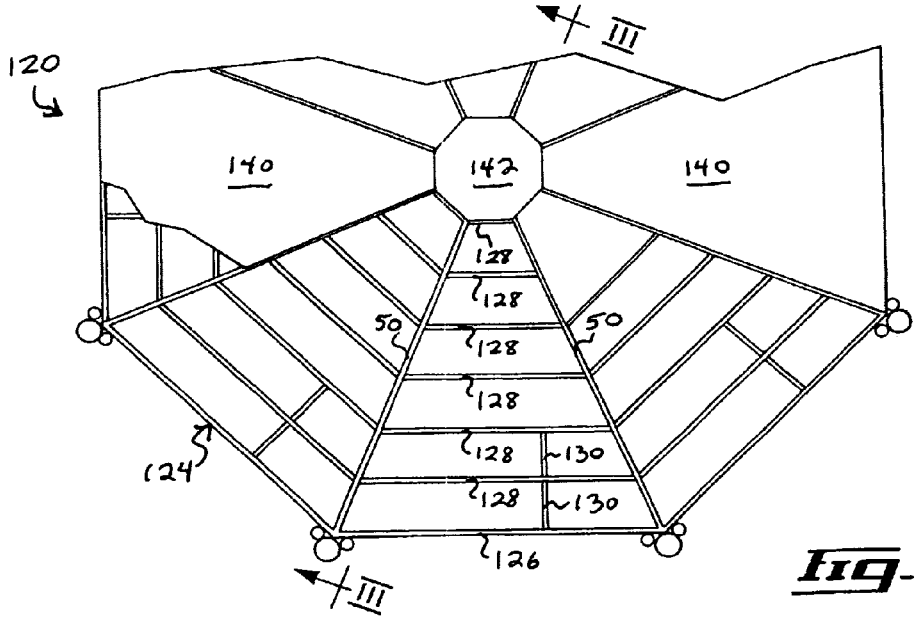
FIG. 2 is a fragmented top plan view of the central portion of the stage shown in FIG. 1.

As best illustrated in FIGS. 1, 2 and 4, the stage platform 14 generally comprises a central portion 120 and an outer peripheral portion 122. The central portion 120 is generally represented by a multilayer covering 125 while the outer peripheral portion 122 is represented by a relatively narrow catwalk circumscribing the central portion 120.

As best illustrated in FIGS. 2 to 5 inclusively, the spider web-like structure 124 defined by the support structure 12 generally comprises a plurality of elongated main beam members 50 disposed in a substantially horizontal and radially outwardly extending configuration, or wagon-wheel configuration, about the central hub connector 38 of the central support column 20. The spider web-like structure 124 further comprises a plurality of outer and inner transversal beam members 126 and 128, with each having a suitable length for being disposed in a substantially equidistant parallel fashion transversally between two adjacent main beam members 50. The outer and inner transversal beam members 126 and 128 are provided respectively at a location adjacent the outer support columns 22 and at a location intermediate the central and outer support columns 20 and 22. The spider web-like structure 124 further comprises a plurality of relatively smaller and radially oriented intermediate beam members 130 disposed perpendicularly between selected parallel outer and inner transversal beam members 126 and 128.

A main beam member 50 may be preferably represented by an elongated and substantially tubular member having preferably an upright rectangular cross-section and proximal and distal ends 46, 84 provided with preferably a pair of corresponding transversal holes (not shown), for anchoring each distal ends thereof in correspondingly compatible portions of the central hub connector 38 and outer hub connector 72 of the central and outer support columns 20, 22 respectively.

Thus, as best illustrated in FIG. 5, each main beam members 50 has a proximal end 46 fixedly anchored in a U-shaped bracket 42 of the central hub connector 38 of the central support column 20 using a suitable fastener such as, for example, a conventional nut and screw combination 132, or the like. The main beam members 50 are radially extending therefrom and have their opposite distal ends 84 fixedly anchored in the central U-shaped channel 82 of the outer hub connector 72 of the outer support columns 22 using, here again, a conventional nut and screw combination 132, or the like.

A main beam member 50 further comprises a plurality of relatively short and upwardly oriented U-shaped support brackets 134 that are oppositely laterally extending from both longitudinal sidewall portions 136 of the main beam member 50. The U-shaped brackets 134 are configured to be oriented toward the center of the stage platform 14 at an inner angle relative to one another that is substantially corresponding to a typical inner angle value between two adjacent peripheral segments of the equilateral polygon defined by the stage platform 14. The U-shaped brackets 134 are configured for slidably receiving thereinto a respective end of one of the inner transversal beam members 128.

As best illustrated in FIGS. 4 and 5, a main beam member 50 further comprises a plurality of substantially equidistantly distributed panel anchoring brackets 138 that are projecting upwardly from a central longitudinal portion of the top surface of the main beam member 50. A panel anchoring bracket 138 has a substantially transversal T-shaped cross-section that is suitably configured and oriented along the longitudinally axis of the main beam member 50, for freely slidably anchoring longitudinal side edges portions of substantially triangular panel-shaped platform modules including multilayer covering 125 disposed between two adjacent main beam members 50 (as best illustrated in FIG. 2).

The outer and inner transversal beam members 126 and 128, as well as the radially oriented intermediate beam members 130, are all preferably represented by an elongated tubular member having substantially similar cross-section configuration and dimension as the main beam members 50 described above.

The outer transversal beam members 126 are disposed such that they are substantially delineating the outer polygon-shaped periphery of the spider web-like structure 124 by having each of their distal ends engaged in the suitably sized and shaped U-shaped channel 82 of the outer hub connector 72 of two adjacent outer support columns 22. These outer transversal beam members 126 may be optionally provided with corresponding transversal through holes at their distal ends thereof.

It is important to be noted that the distal ends of the outer transversal beam members 126 do not have to be fixedly anchored in the U-shaped channels 82 of the outer hub connectors 72 using nuts and screw combinations, or the like. The outer transversal beam members 126 may rather be simply slidably engaged in the U-shaped channels 82 since the fixedly anchored main beam members 50 between the central support column 20 and outer support columns 22 are sufficient to hold the integral octagonal shape of the spider web-like structure 124 once all the outer transversal beam members 126 are positioned in the outer hub connectors 72.

The outer transversal beam members 126 are further characterized in that they may be provided with one or more U-shaped brackets (not shown), that are similar to the U-shaped brackets 134 provided along the sidewalls of the main beam members 50, and which are perpendicularly laterally extending along a longitudinal sidewall portion adapted to be oriented toward the center of the stage platform 14. These U-shaped brackets are for freely slidably receiving and supporting therein a distal end of a radially oriented intermediate beam members 130, which will be described more below.

The plurality of inner transversal beam members 128 are characterized in that they are provided in gradually shorter lengths comparatively to the outer transversal beam members 126 such that they may have their distal ends slidably engaged in the oppositely corresponding U-shaped brackets 134 of two adjacent main beam members 50, as best illustrated in FIG. 2.

Likewise the outer transversal beam members 126, the inner transversal beam members 128 are further characterized in that selected beam members may be provided with perpendicularly laterally extending U-shaped brackets (not shown) distributed at suitable position along one or both of their longitudinal sidewall portions, for freely slidably receiving and supporting therein a distal end of a radially oriented intermediate beam members 130.

The radially oriented intermediate beam members 130 are characterized in that they are adapted to be oppositely slidably engaged in oppositely corresponding U-shaped brackets between selected outer and inner transversal beam members 126 and 128 respectively, as exemplified in FIG. 2.

As best illustrated in FIGS. 2 and 4, the spider web-like structure 124 is covered with a multilayer covering 125 generally comprising a plurality of suitably sized and shaped floor panels 140 and 142 made of a substantially rigid material such as, for examples, presswood, agglomerated wood, a suitable plastic composite material, or the like.

The radially disposed floor panels 140 preferably have a substantially truncated triangular configuration adapted to be slidably engaged, in an inwardly pointing horizontal movement, between oppositely corresponding T-shaped panel anchoring brackets 138 on top of two adjacent main beam members 50. The central floor panel 142 has a suitably sized equilateral polygon shape adapted to be laid in the recess thus created at the center of the radially disposed floor panels 140, where it is circumscribed in place therebetween. The floor panels 140 and 142 are suitably sized such that the peripheral edge of the central floor panel 142 at least slightly overlaps the proximal ends 46 of the converging main beam members 50, for a firm peripheral support of the latter.

Now referring more particularly to FIG. 4, the rigid floor panels 140 and 142 are, in turn, preferably covered with a plurality of suitably thick and shock absorbing panels 144 made of a resilient, foam-like material, or the like. Finally, the shock absorbing panels 144 may be in turn preferably covered with a sufficiently durable sheet of flexible material 146 such as, for examples, a polymer, a fabric, or the like. The floor panels 140 and 142 and absorbing panels 144 form platform modules part of a modular stage platform 14.

The stage platform 14 further includes an outer peripheral portion 122, or catwalk, that may be preferably represented by a plurality of suitably rigid and elongated floor panels 150 having a substantially isosceles-trapezoid configuration. Each elongated floor panel 150 may be represented by an assembly of, for example, a substantially rigid panel 152 made of, here again, presswood, agglomerated wood, a suitable synthetic material, or the like, that is structurally reinforced by a suitable peripheral frame structure 154 made of, for example, a suitable metal such as rust-protected steel or aluminum. The outer peripheral portion 122, or catwalk, is provided peripherally to the fenced enclosure 16.

Preferably, at least the inner corner portions 156 of the peripheral frame structure 154 form a suitably sized downwardly protruding edge adapted to be slidably engaged in the downwardly extending slots 64 provided at the top end of the outer support columns 22.

Thus, a plurality of elongated floor panels 150 may have their inner corner portions 156 slidably engaged in the slots 64 of adjacent outer support columns 22, and a corresponding number of outer support posts 26, having a suitably adapted upper end connected to, and supporting adjacent outer corners 158 thereof, for forming an octagon-shaped outer peripheral portion 122, or catwalk, around the central portion 120 of the stage platform 14.

Optionally, additional reinforcement braces (not shown) may have one end connected proximal the lower end of the outer support posts 26, and their opposite end thereof connected to a suitably disposed attachment ear provided proximal the main member base 56 or main member upper end 58 of the outer support columns 22.

As illustrated in FIG. 1, the fenced enclosure 16 substantially delineates a polygon-shaped enclosure around the central portion 120 of the stage platform 14 that is accessible through at least one, but typically a plurality, of hinged access doors 160. Typically, the fenced enclosure 16 is substantially in register with a perimeter defined by the outer support columns 22.

Typically, the fenced enclosure 16 is composed of a plurality of individual fence panels 162. A fence panel 162 generally comprises a substantially rectangular frame structure 164 and a chain-link mesh 167, or the like, attached within the frame structure 164. The oppositely disposed lower end corners of the frame structure 164 defines a pair of substantially parallel and downwardly extending stems 166 adapted to by adjustably fixedly anchored in the hollow cylindrical member 96 of the laterally adjustable fence panel anchoring brackets 94 provided proximal the main member upper end 58 of the outer support columns 22.

A plurality of reinforcement three part bracket 169 may be preferably used to interconnect adjacent vertical frame portions of the fence panels 162. Selected fence panels 162 may additionally comprise an integrated door frame and hinged access door 160 as mentioned above. Typically, the various solid frame structure components accessible from within the fenced enclosure 16 may be preferably covered with suitable padding elements 170 to avoid injuring sport athletes when they are performing therein.

The stage 10 is typically provided in the form of a kit including all the required parts for assembling the stage 10. In a manner readily apparent to one skilled in the art of portable stage structures, a preferred method of assembly and disassembly of the stage 10 of the present invention may be generally described as follows.

In a first step, an upright central support column 20 is suitably positioned on a substantially horizontally planar and unobstructed floor area or ground surface 172.

In a second step, the outer support columns 22 are positioned at a distance from the central support column 20 that is substantially equivalent to the length of a main beam member 50, and such that they are substantially aligned radially correspondingly with each radially oriented U-shaped brackets 42 of the central hub connector 38. The outer support columns 22 are thus typically positioned circumferentially equidistantly from each other. In other words, the outer support columns 22 are provided around the central support column 20 with the outer support columns 22 being substantially equidistant from the central support column 20 and adjacent pairs of the outer support columns 22 being all substantially equidistant.

In a third step, and consecutively or concurrently with the second step above, slidably engaging and fixedly anchoring, using nut and screw combinations 132, the distal ends of main beam members 50 in each oppositely corresponding aligned pairs of U-shaped brackets 42 and U-shaped channels 82 of the central support column 20 and outer support columns 22 respectively.

In a fourth step and, here again, consecutively or concurrently with the second and third steps described above, the outer and inner transversal beam members 126 and 128, as well as the radially oriented intermediate members 130, are slidably engaged in oppositely corresponding U-shaped channels 82 and brackets 134, in order to complete the spiderweb structure 124. This provides coupling of each of the outer and inner transversal beam members 126 and 128 to a respective pair of adjacent ones of the outer support columns 22 such that the inner and outer transversal beam members 126 and 128 are supported by the outer support columns 22 while remaining slidably movable relative thereto.

In a fifth step, the truncated, triangular floor panels 140 are slidably inserted between T-shaped panel anchoring brackets 138 along the top longitudinal surface of adjacent main beam members 50, followed with the central floor panel 142 that is inserted in the thus formed correspondingly shaped recess at the center of the stage platform 14. The floor panels 140 and 142 may then be optionally covered with the shock absorbing panels 144 and finally the resistant flexible sheet of material 146. In this step, the stage platform 14 is supported on the support structure 12 such that the stage platform 14.

In a sixth step, the fenced enclosure 16 is assembled above the stage platform 14 by being adjustably anchored thereonto. This is performed by inserting and adjustably fixing the downwardly extending stems 166 from each lower end corners of the fence panels 162 into the hollow cylindrical member 96 of the laterally adjustable fence panel anchoring bracket 94 of adjacent outer support columns 22, using the locking screw 100. A plurality of reinforcement three part bracket 169 may be used to the structural integrity between adjacent fence panels 162. Further preferably, padding elements 170 may then be attached at suitable locations along at least the structural members that are accessible from the interior walls of the fenced enclosure 16.

In a last step, the elongated floor panels 150 forming the outer peripheral portion 122 may have their inner corner portions 156 slidably engaged in the downwardly extending slots 64 at the top end of the outer support columns 22, and their adjacent outer corners 158 connected to, and thus supported by, the top end of outer support posts 26.

The disassembly of the stage 10 of the present invention is substantially the reverse order of the steps described above.

Thus is provided a strong and stable, integrated stage 10 that is easily assembled and disassembled, as well as easily transportable between show venues.

Although the present invention has been described hereinabove by way of preferred embodiments thereof, it can be modified, without departing from the spirit and nature of the subject invention as defined in the appended claims.

What is claimed is:

1. A stage, said stage comprising:

a support structure, a stage platform supported by said support structure and a fenced enclosure provided above said stage platform;

said support structure including a substantially upstanding central support column;

a plurality of substantially upstanding outer support columns, said outer support columns being provided around said central support column, said outer support columns being substantially equidistant from said central support column and adjacent pairs of said support columns being all substantially equidistant;

a plurality of radially extending main beam members each extending between said central support column and a respective one of said outer support columns; and a plurality of circumferentially extending transversal beam members each extending between a respective pair of adjacent ones of said outer support columns;

each of said outer support columns defining a pair of support channels each for receiving a respective end of one of said transversal beam members thereinto;

wherein said main beam members are fixedly anchored to said central and outer support columns and said transversal beam members are inserted in said support channels while remaining slidable relative thereto.

2. A stage as defined in claim 1, wherein said stage platform has an equilateral polygonal configuration having a number of sides equal to a number of said outer support column.

3. A stage as defined in claim 1, wherein said stage platform is modular and includes a plurality of platform modules.

4. A stage as defined in claim 3, wherein said main beam members each include at least one module anchoring bracket, said module anchoring brackets anchoring said platform modules to said main beam members.

5. A stage as defined in claim 4, wherein said fenced enclosure includes a plurality of fence panels, said outer support columns including each a pair of anchoring brackets, said anchoring brackets anchoring said fence panels to said outer support columns.

6. A stage as defined in claim 5, wherein said anchoring brackets are slidably movable with respect to the remainder of said outer support columns for adjusting their position relative to said remainder of said outer support columns.

7. A stage as defined in claim 1, wherein said transversal beam members are outer transversal beam members, said support structure further including a plurality of inner beam members each extending between one of said pairs of adjacent ones of said main beam members at a location intermediate said central and outer support columns.

8. A stage as defined in claim 7, wherein said main beam members, outer transversal beam members and inner transversal beam members are configured in a spider-web like configuration.

9. A stage as defined in claim 7, wherein said support structure further includes radially oriented intermediate beam members disposed between adjacent pairs of auxiliary beam members.

10. A stage as defined in claim 7, wherein said main beam members each define laterally extending U-shaped brackets slidably receiving thereinto a respective end of one of said inside transversal beam members.

11. A stage as defined in claim 1, further comprising a plurality of support posts supporting each a respective one of said main beam members between said central support column and a respective one of said outer support columns.

12. A stage as defined in claim 1, wherein said stage platform protrudes radially outwardly from said outer support columns, said support structure further including a plurality of support posts supporting said stage platform at a location located radially outwardly with respect to said outer support columns.

13. A stage as defined in claim 1, wherein said central support column is crowned by a central hub connector, said central hub connector defining a plurality of main beam attachments fixedly attaching a respective one of said main beam members to said central hub connector.

14. A stage as defined in claim 13, wherein said main beam attachments each include an upwardly opening U-shaped bracket receiving thereinto a respective one of said main beam members, a fastener extending through both said upwardly opening U-shaped bracket and said main beam member.

15. A stage as defined in claim 1, wherein each of said outer support columns includes a substantially elongated main member defining a main member base and a longitudinally opposed main member upper end, said outer support columns each including three upwardly opening U-shaped members provided substantially adjacent said main member upper end and oriented for receiving a respective one of said main and pair of transversal beam members coupled to said outer support column, a fastener extending through both said upwardly opening U-shaped bracket and said main beam member that are coupled to each other.

16. A stage as defined in claim 1, further comprising a plurality of brace members extending between said main beam members and said central and outer support columns.

17. A stage as defined in claim 1, wherein said fenced enclosure is substantially in register with a perimeter defined by said outer support columns.

18. A stage as defined in claim 1, wherein said stage platform defines a catwalk provided peripherally to said fenced enclosure.

19. A kit for assembling a stage, said kit comprising:

a support structure, a modular stage platform supportable by said support structure and a fenced enclosure positionable above said stage platform;

said support structure including a central support column;

a plurality of outer support columns, said outer support columns being positionable around said central support column, each of said outer support columns defining a pair of support channels;

a plurality of main beam members each fixedly attachable between said central support column and a respective one of said outer support columns; and a plurality of transversal beam members each positionable between a respective pair of adjacent ones of said outer support columns and coupled thereto in a manner allowing slidable movements of said transversal beam members with respect to said support channels.

20. A method of assembling a stage using a kit, said kit including a support structure, a modular stage platform supportable by said support structure and a fenced enclosure positionable above said stage platform; said support structure including a central support column; a plurality of outer support columns, said outer support columns being positionable around said central support column, each of said outer support columns defining a pair of support channels; a plurality of main beam members each fixedly attachable between said central support column and a respective one of said outer support columns; and a plurality of transversal beam members each positionable between a respective pair of adjacent ones of said outer support columns and coupled thereto in a manner allowing slidable movements of said transversal beam members with respect to said support channels, said method comprising:

assembling said support structure, assembling said support structure including:

positioning in an upright position said central support columns;

positioning in an upright position said outer support columns at a distance from said central support column that is substantially equal to a length of a respective main beam member from said plurality of main beam members, said outer support columns being positioned circumferentially equidistantly from each other;

fixedly anchoring each main beam member from said plurality of main beam members to said central support column and to a respective one of said outer support columns;

coupling each of said transversal beam members to a respective pair of adjacent ones of said outer support columns such that said transversal beam members are supported by said outer support columns while remaining slidably movable relative thereto;

assembling said stage platform on said support structure such that said stage platform is supported by said support structure; and assembling said fenced enclosure above said stage platform.

* * * * *